United States Patent [19]

Voss

[11] Patent Number: 5,009,095

[45] Date of Patent: Apr. 23, 1991

[54] METHOD FOR FORMING A COLLARED HOLE IN SHEET MATERIAL

[75] Inventor: Harlan F. Voss, Punta Gorda, Fla.

[73] Assignee: Tridan Tool & Machine, Inc., Danville, Ill.

[21] Appl. No.: 462,618

[22] Filed: Jan. 9, 1990

[51] Int. Cl.[5] ..... B21D 28/26

[52] U.S. Cl. ..... 72/335; 72/327; 29/890.043

[58] Field of Search ..... 72/327-330, 72/333, 335, 336, 339; 29/890.043, 890.044, 890.052

[56] References Cited

U.S. PATENT DOCUMENTS

| | | | |
|---|---|---|---|
| 2,135,418 | 11/1938 | Tinnerman | 72/335 |
| 2,246,022 | 6/1941 | Tinnerman | 72/335 |
| 3,108,371 | 10/1963 | Munse | 72/335 |
| 4,234,041 | 11/1980 | Melnyk | 29/890.52 |

FOREIGN PATENT DOCUMENTS

| | | | |
|---|---|---|---|
| 31420 | 2/1982 | Japan | 72/337 |
| 64426 | 4/1982 | Japan | 29/890.043 |
| 127092 | 7/1983 | Japan | 29/890.043 |
| 82230 | 5/1985 | Japan | 72/335 |
| 349569 | 12/1960 | Switzerland | 29/890.052 |
| 1383493 | 2/1975 | United Kingdom | 29/890.043 |

*Primary Examiner*—Daniel C. Crane

*Attorney, Agent, or Firm*—Woodard, Emhardt, Naughton, Moriarty & McNett

[57] ABSTRACT

A progressive die for producing collared holes in a sheet. The die includes a first station having a pattern of three punches producing three spaced apart holes in the sheet. A main punch at the second die station is extended into the three holes producing a single hole with portions of the sheet extending therein. The straightening punch mounted at the third station of the die has a diameter larger than the single main hole and is extended therethrough bending the portions extending into the hole outwardly forming a collar. The curling punch mounted at the fourth station of the die, curls the distal end of the collar outwardly.

6 Claims, 4 Drawing Sheets

METHOD FOR FORMING A COLLARED HOLE IN SHEET MATERIAL

BACKGROUND OF THE INVENTION

1. Field of the Invention

This invention is in the field of progressive dies for forming sheets of metal.

2. Description of the Prior Art

Heat transfer fins include collared holes which receive coolant tubes. The collars surrounding each hole are secured to the coolant tubes providing a unified construction as well as effective heat transfer. Traditionally, the collared holes are produced by extending a punch through the fin and drawing or stretching the material outwardly from the main body of the fin. The drawing operation may result in undesirable metallurgical properties. I have therefore devised a method and die for producing a collared hole minimizing the drawing of the metal. The method and die disclosed herein forms the collar by means of bending metal outwardly.

The height of each collar surrounding a fin hole depends on final product requirements. As a result, the punch and bushing used to form the collar must be changed for each different collar height. Disclosed herein is a progressive fin die designed to produce collared holes of varying heights through the selection of a main punch extendible through a pattern of holes initially formed in the sheet of material.

SUMMARY OF THE INVENTION

One embodiment of the present invention is a method of producing a collared hole in a sheet of material comprising the steps of moving a sheet through a die, forming a plurality of first holes in the sheet for each collared hole to be formed in the sheet while leaving the first holes spaced apart so material of the sheet extends between the first holes, removing some of the material from between the first holes to transform the plurality of first holes into a single main hole with portions of material extending inwardly in the main hole, and, then bending the portions outwardly forming a collar.

Another embodiment of the present invention is a progressive die for forming a collared hole in a sheet of material comprising a main frame, a plurality of spaced apart first punches mounted on the main frame at a first station and arranged in a pattern about a center point, a plurality of first bushings mounted on the main frame at the first station and arranged in the pattern to receive the first punches and form a plurality of first holes in a sheet of material leaving material extending between the holes, a main punch mounted on the main frame at a second station, a main bushing mounted on the main frame to receive the main punch removing some of the material extending between the holes forming a main hole in the sheet of material and leaving portions of material extending inwardly in the main hole, a straightening punch mounted on the main frame at a third station, and a straightening bushing mounted on the main frame to receive the straightening punch to bend the portions outwardly.

It is an object of the present invention to provide a new and improved method for producing collared holes in a sheet of material.

A further object of the present invention is to provide a new and improved die for producing collared holes in a sheet of material.

An additional object of the present invention is to provide a method and tool for producing a collared hole in a sheet by bending the sheet.

Yet another object of the present invention is to provide a new and improved method and tool for producing collared holes in a fin of variable heights.

Related objects and advantages of the present invention will be apparent from the following description.

DESCRIPTION OF THE PREFERRED EMBODIMENT

Figure 3:
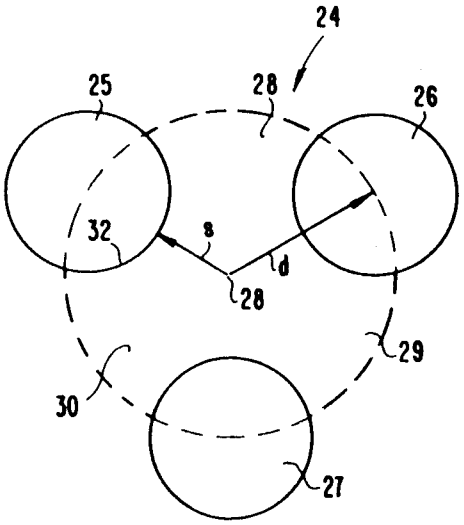
FIG. 3 is a plan view of the pattern of the initial holes forming the collar.
Figure 2:
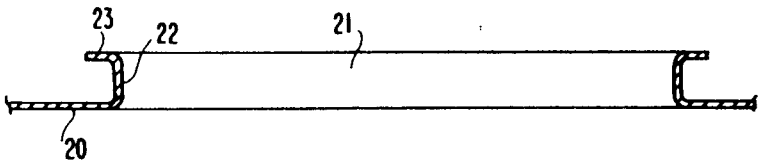
FIG. 2 is a cross-sectional view taken along the line 2—2 of FIG. 1 and, viewed in the direction of the arrows.
Figure 1:
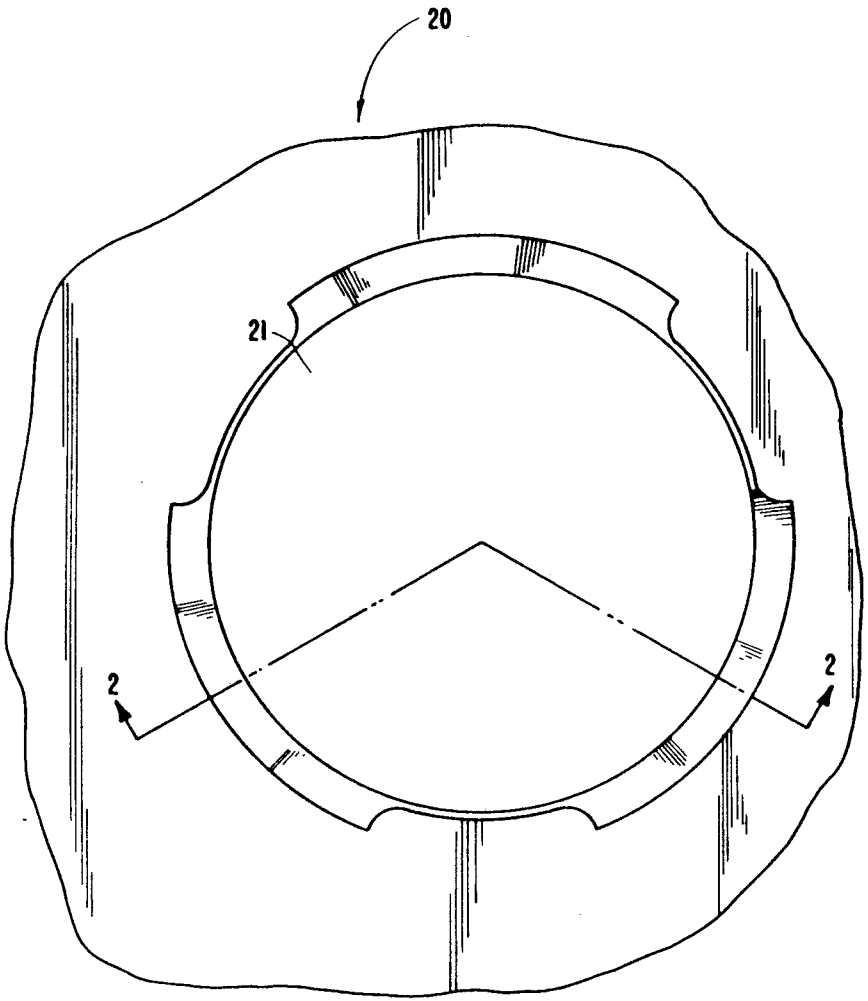
FIG. 1 is a top view of a fin collar made by the progressive die disclosed herein.
Figure 5:
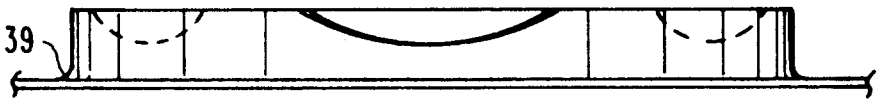
FIG. 5 is a side view of the collared hole prior to curling of the top edge.
Figure 4:
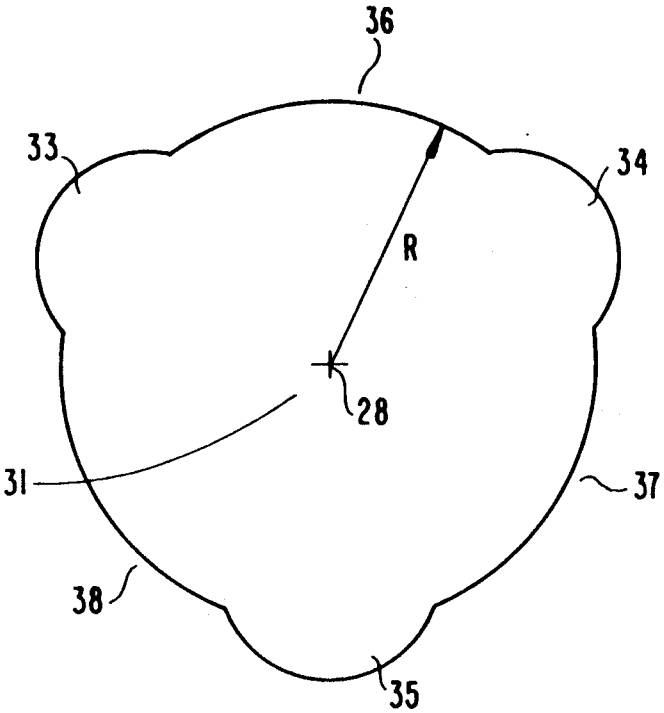
FIG. 4 is a plan view of the three holes of FIG. 3 enlarged into a single hole.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIGS. 1–5, there is shown a sheet of material 20 having a collared hole 21 produced therein. Collared holes are particularly useful in attaching or securing a sheet of material such as a metal heat transfer fin to a coolant tube extending therethrough. A collared hole allows not only for the attachment of the fin to the coolant tube, but also insures effective heat transfer therebetween. Surrounding hole 21 is a continuous wall 22 integrally joined at its bottom end to sheet 20 with wall 22 extending circumferentially around the hole. The top end 23 of wall 22 is flared or curled outwardly.

The method of producing collared hole 21 in a sheet of material includes the first step of moving sheet 20 through a progressive die past four stations. At the first station, a pattern 24 (FIG. 3) of holes are formed in the sheet. In the embodiment shown in the drawing, pattern 24 includes three spaced apart holes 25 through 27 with each hole being circular and of the same radius. Further, the three holes are located an equal distance "d" from a center point 28 and are spaced equally thereabout in 120° intervals. The present invention contemplates and includes a method for producing a collared hole utilizing a pattern of initial holes less than or greater than three holes such as shown in FIG. 3. Most importantly, holes 25 through 27 are spaced apart leaving the material therebetween. For example, material 28 extends between holes 25 and 26, material 29 extends between holes 26 and 27, and material 30 extends between holes 27 and 25.

Once pattern 24 is formed in the sheet, the sheet is then moved and indexed to the next station of the die whereat a single main hole 31 is produced that is formed from the three holes 25 through 27. This is accomplished by extending a single punch through sheet 20 with the punch being centrally aligned with the center point 28. The radius "R" (FIG. 4) of the main punch or of hole 31 is greater than the distance "S" (FIG. 3) from center point 28 to the nearest portion of the edge of any hole 25 through 27. For example hole 25 includes a circumferentially extending edge 32, the nearest portion of which is located distance "S" from center point 28. Distance "S" is also equal to the distance of the nearest portion of the edge of hole 26 to center point 28. Likewise, the nearest portion of the edge of hole 27 to the center point 28 is also equal to the same distance "S". As a result, material is removed from between holes 25 through 27 producing a single hole 31 having ears 33, 34 and 35. Portions of sheet 20 extend between the ears into hole 31. That is, sheet portion 36 of the sheet extends into hole 31 between ears 33 and 34, sheet portion 37 extends between ears 34 and 35 and sheet portion 38 extends into the hole between ears 35 and 33.

Sheet 20 is then moved and indexed to the third station of the progressive die whereat portions 36, 37 and 38 are bent outwardly from the sheet. A straightening punch centered on center point 28 is extended through hole 31 forming the collar extending around the hole. The straightening punch has an outside diameter more than twice the combined distance of "S" plus the diameter of one of the small holes 25–27. As a result, the straightening punch as it is extended through hole 31 first draws the sheet continuously and circumferentially around hole 31 forming the base 39 of the collar with portions 36, 37 and 38 then being bent or forced outwardly from the sheet forming wall 22 extending continuously around the hole.

The sheet is then moved to a fourth station for forming or curling the top edge of wall 22. Wall 22 extends perpendicularly outward from sheet 20 with the top portion 23 then being forced backwardly away from the hole to extend parallel to the plane of sheet 20.

The height of the collar or the distance wall 22 extends outwardly from sheet 20 is controlled by the amount of material extending between ears 33 through 35. For example, in order to obtain a short collar or to decrease the height of wall 22, the radius "R" should be increased so that material 36, 37 and 38 extend only a short distance into hole 31. On the other hand, in order to obtain a high collar or to increase the height of wall 22, radius "R" should be decreased allowing portions 36 through 38 to extend a greater distance into hole 31. The distance portions 36 through 38 extend into hole 31 may be controlled by varying the radius "R" of the punch forming hole 31 and can likewise be controlled by varying the size of holes 25 through 27 as well as the distance "S". For example, with the size, spacing and pattern of the holes shown in FIG. 3 remaining constant, the radius "R" of the punch used to form hole 31 may be increased to provide for a short collar whereas radius "R" may be decreased to provide for a long collar.

Figure 6:
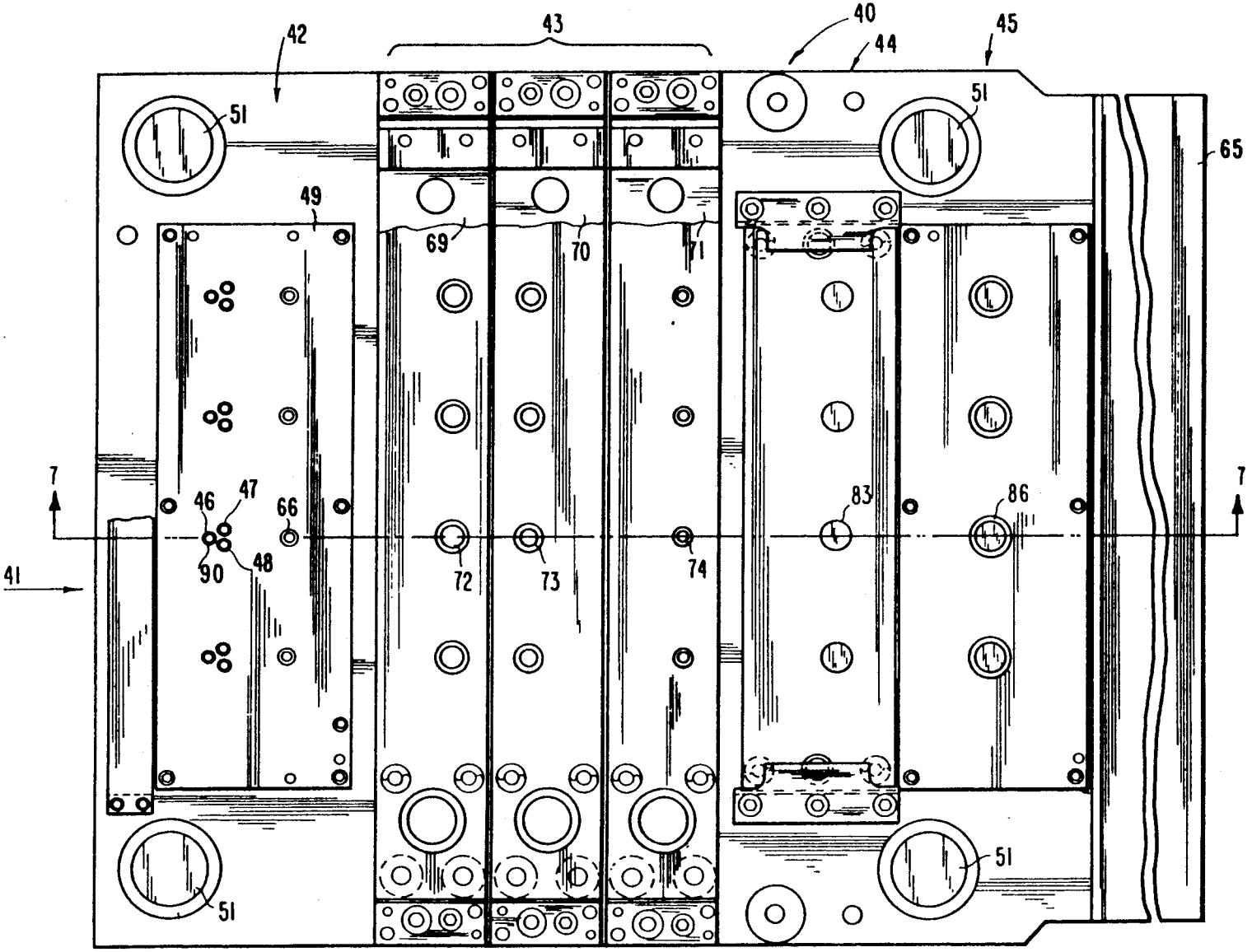
FIG. 6 is a fragmentary plan view of a progressive fin die for producing the collared hole of FIG. 1.
Figure 7:
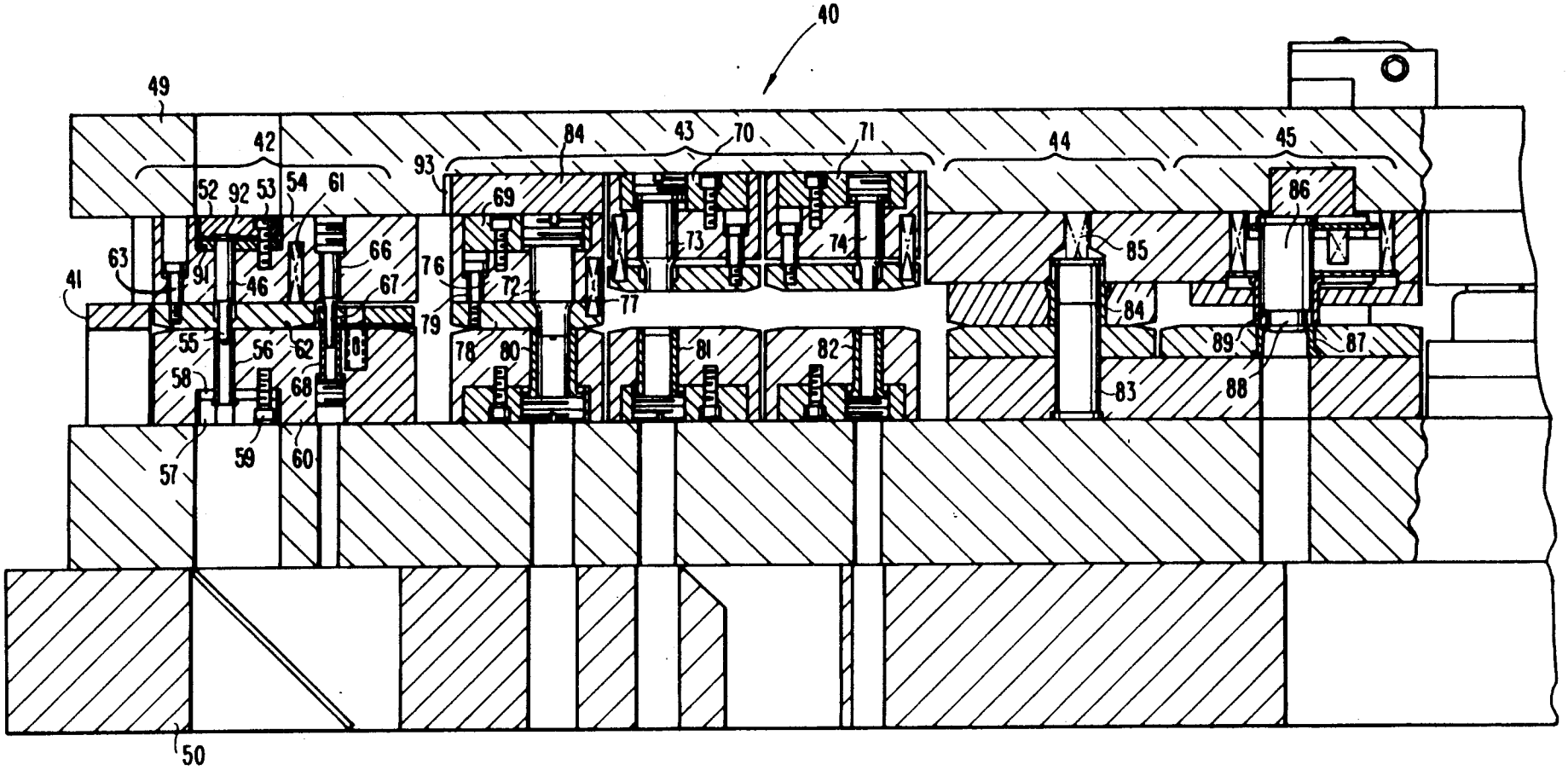
FIG. 7 is a fragmentary cross-sectional view taken along the line 7—7 of FIG. 6 and viewed in the direction of the arrows.

A progressive die 40 is shown in FIGS. 6 and 7 for producing the collared hole previously described. The entrance to die 40 is at mouth 41 where the sheet of material extends into the die and is sequentially located at four stations for producing the collared hole. The first station 42 includes the individual patterns of small punches for producing holes 25 through 27 in a sheet of material. The separate patterns are arranged in a row extending across the width of the die to simultaneously produce a plurality of patterns 24 of small holes in the sheet of material. For example, one such pattern includes three punches 46, 47 and 48 fixedly mounted by conventional means to a press plate reciprocally mounted in the vertical direction to a bottom or bolster plate 50 by means of a plurality of columns 51. Each punch 46 through 48 is aligned with a bushing fixedly mounted to the bolster plate 50. One such punch and bushing will be described, it being understood than a similar description applies to the remaining two punches and bushings in the pattern. Punch 46 has a cap shaped top end 92 positioned between a pair of plates 91 and 52 secured by fastener 53 to plate 54 in turn mounted to die shoe 49. The die shoe 49 in turn is mounted to the vertically reciprocal press. The bottom end 55 of punch 46 is extendible downwardly into a cylindrical bushing 56 having a flared bottom end mounted between two plates 57 and 58 in turn attached by fastener 59 to plate 60 mounted to bolster plate 50.

A captive spring 61 within plate 54 urges stripper plate 62 downwardly on guide pin 63 to force or eject the sheet of material from punch end 55 as the press is opened. The sheet of material is initially extended between plates 60 and 62 with the press then being closed forcing the punches downwardly forming holes 25 through 27. The pattern of the three punches 46 through 48 are arranged about a center point having the aforementioned spacing and size requirements previously discussed for producing holes 25 through 27.

Conventional means 65 (FIG. 6) located at the end of the progressive die is operable to force the sheet of material through the progressive die and sequentially stop the sheet at the individual stations for the respective operations. In order to properly index the pattern of holes at each station, a pilot rod 66 is fixedly mounted to plate 54. Rod 66 has a bottom end 67 sized identically to the leading hole produced by punch 46 which is subsequently moved beneath rod 66 whereupon closure of the press results in pilot rod 66 entering through the hole produced by punch 46 and precisely locating the pattern of holes downstream for the subsequent operations at the remaining stations. A bushing 68 is located immediately beneath rod 66 to receive the distal end 67.

The second station 43 of the progressive die is composed of a number of main punches for producing hole 31. In the embodiment shown in FIGS. 6 and 7, station 43 includes three separate plates 69, 70 and 71, each of which has a plurality of punches for producing hole 31. The punches mounted to plate 69 are identically sized, but are of a different size as compared to the punches mounted to plates 70 and 71. Likewise, the punches mounted to plate 70 are identically sized, but are different from the punches mounted to plate 69 and 71 with the punches mounted to the plate 71 also being identically sized. In the embodiment shown in FIG. 6, punches 72 mounted to plate 69 have a larger outside diameter than the punches 73 mounted to plate 70 which in turn have a larger outside diameter as compared to the punches 74 mounted to plate 71. Two of the plates 69 through 71 are deactivated and held in an upward position as the press closes so that the punches mounted to the remaining plate will remove the desired amount of material extending between holes 25 through 27.

Punches 72 have top ends fixedly mounted to plate 69 in turn fixed to plate 76. A spring 77 is captive in plate 76 to urge downwardly stripper plate 78 which is slidably mounted on guide pin 79. The reduced diametered bottom distal end of punch 72 extends downwardly into bushing 80 fixedly mounted by conventional means to bolster plate 50. Opening of the press results in the stripper plate 78 moving downwardly past the distal end of punch 72 stripping the sheet of material therefrom. Likewise, punches 73 and 74 are mounted to plates 70 and 71 in a manner similar to the mounting of punch 72 to plate 69. Plates 70 and 71 also have a stripper plate similar to stripper plate 78 with bushings 81 and 82 being mounted to bolster plate 50 in a manner similar to the mounting of bushing 80.

Die shoe 49 includes a recess 93 extending across the second station 43 to enable a bar 84 to be manually inserted therein immediately over plate 69, 70 or 71 depending on the particular set of main punches to be utilized. For example, bar 84 is shown located in recess 93 immediately over plate 69 for holding punches 72 downwardly relative to punches 73 and 74. As a result, when the press closes, the distal ends of punches 72 will enter bushings 80 whereas the distal ends of punches 73 and 74 will remain spaced apart from the bushings therebeneath. Conventional fastening means or spring means are used to secure plates 70 and 71 upwardly relative to plate 69. In the event punches 73 or 74 are to be utilized in lieu of punches 72, then plate 84 is repositioned from over plate 69 to over, respectively, plate 70 or 71 with the two remaining plates secured in the upward position. Once the pattern 24 of three holes 25 through 27 have been produced in the first station, the sheet of material is moved to the right as viewed in FIG. 7 until the center point 28 of the pattern is located immediately beneath the central longitudinally extending axis of punch 72 or punches 73 or 74 depending upon the punch to be utilized. The press is then closed with the result that hole 31 is produced.

Each of the punches 46 through 48 have a outer forming surface 90 (FIG. 6) located an equal distance from the center point 28 located between the three punches. The radius defining the outer surface of the selected punches 72 through 74 is greater than the distance from the center point 28 to surface 90 allowing the main hole 31 formed by the selected punch 72 through 74 to break into holes 25–27.

The third station 44 includes a straightening punch 83 fixedly mounted to bolster plate 50 with the top distal end of the punch being aligned with and slidable into a bushing 84 in turn mounted to the upper die shoe. A spring loaded ejector 85 is positioned within bushing 84 to force the sheet of material therefrom as the press opens. The diameter of straightening punch 83 is larger than the diameter of the particular main punch 72 through 74 selected to produce hole 31 and also greater than the combined distance "S" plus the diameter of one of the holes 25–27 with the result that punch 83 first draws material continuously around main hole 31 forming base 39 (FIG. 5) and then bends portions 36 through 38 outwardly forming a collar continuously surrounding the main hole.

The fourth station 45 has a curling punch 86 fixedly mounted to the upper die shoe and is aligned immediately over a bushing 87 fixedly mounted to the bottom die shoe. Whereas straightening punch 83 has a constant diameter along its length, the curling punch 86 has a reduced diametered bottom end 88 forming a ledge 89 for producing the curled or flare 23 in the top edge of the fin collar. Curling punches 86 are aligned in a row across the width of station 45. Likewise, punches 72 through 74 and punches 83 are aligned across the width of the second and third stations. Most importantly, each pattern of holes 46 through 48 have aligned downstream thereof punches 72 through 74 and straightening punches 83 and curling punches 86. Thus, as the sheet of material is moved through the progressive die, the center point 28 of the first pattern 24 of holes 25 through 27 produced by the pattern of punches 46 through 48 is centrally aligned beneath either main punches 72, 73 or 74 to produce hole 31. The sheet is then moved to the third station so that the center 28 of hole 31 of the sheet is aligned immediately beneath and along the central longitudinal axis of straightening punch 83 producing wall 22. The sheet is then moved to the fourth station so that central longitudinal axis extending through hole 21 surrounded by wall 22 is positioned along the longitudinal central axis of a curling punch 86. Once the collared holes are produced, the sheet of material is moved to subsequent stations where conventional operations occur such as slitting, cutting and sizing of the sheet 20 to the final product size.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of producing a collard hole in a sheet of material comprising the steps of:

moving a sheet through a die;

sequentially stopping said sheet at multiple stations;

forming with a plurality of first punches a plurality of first holes in said sheet in a certain size and configuration for each collared hole to be formed in said sheet while leaving said first holes spaced apart so material of said sheet extends between said first holes;

removing with a main punch some of said material from between said first holes to transform said plurality of first holes into a single main hole having a center and with portions of material extending inwardly and terminating a distance from said center of said main hole;

extending a straightening punch through said single main hole after said removing step to draw said sheet around said main hole forming a collar of a predetermined height which extends perpendicularly from said sheet; and, controlling and varying said predetermined height by keeping said certain size and configuration of said first holes fixed while selecting the radius of said main punch (1) to increase said distance with a large radius of said main punch providing a small height of said collar and (2) reduce said distance with a small radius of said main punch providing a large height of said collar.

2. The method of claim 1 wherein:

said forming step includes positioning said first holes the same radial distance from a center point.

3. The method of claim 1 wherein:

said extending step includes extending said straightening punch to draw said sheet continuously and circumferentially around said main hole.

4. The method of claim 2 wherein:

said first holes are circular with the same radius and are arranged in patterns of three.

5. The method of claim 4 and comprising the further step of:

bending with a curling punch the distal end of said portions backwardly parallel to said sheet forming a lip extending away from said main hole.

6. A method of producing a collared hole in a sheet of material comprising the steps of:

moving a sheet through a die;

sequentially stoping said sheet at multiple stations;

forming with a plurality of first punches a plurality of first holes in said sheet in a certain size and configuration for each collared hole to be formed in said sheet while leaving said first holes spaced apart so material of said sheet extends between said first holes;

removing some of said material from between said first holes to transform said plurality of first holes into a single main hole having a center and with portions of material extending inwardly and terminating a distance from said center of said main hole;

extending a punch through said single main hole to draw said sheet around said main hole forming a collar of a predetermined height which extends perpendicularly from said sheet; and, controlling and varying said predetermined height by keeping said certain size and configuration of said first holes fixed while selecting the radius of said punch (1) to increase said distance with a large radius of said punch providing a small height of said collar and (2) reduce said distance with a small radius of said punch providing a large height of said collar.

* * * * *